United States Patent [19]

Morgan

[11] 4,334,805

[45] Jun. 15, 1982

[54] ROOF BOLT AND CRADLE ARRANGEMENT

[75] Inventor: Bennie E. Morgan, Morganfield, Ky.

[73] Assignee: Roof Control, Inc., Morganfield, Ky.

[21] Appl. No.: 189,027

[22] Filed: Sep. 22, 1980

[51] Int. Cl.[3] ..... E21D 20/02

[52] U.S. Cl. ..... 405/261; 405/260

[58] Field of Search ..... 405/259–261; 411/15–28, 32

[56] References Cited

U.S. PATENT DOCUMENTS

| | | | |
|---|---|---|---|
| 2,850,937 | 9/1958 | Ralston | 405/259 X |
| 4,091,628 | 5/1978 | Kelley | 405/259 X |
| 4,124,983 | 11/1978 | Weatherby | 405/260 |
| 4,179,861 | 12/1979 | Brown | 405/261 |

FOREIGN PATENT DOCUMENTS

| | | | |
|---|---|---|---|
| 84938 | 1/1955 | Norway | 405/260 |

*Primary Examiner*—Dennis L. Taylor
*Attorney, Agent, or Firm*—Warren D. Flackbert

[57] ABSTRACT

A roof bolt having particular adaptability for use in a mine defined by soft shale formations utilizing an anchor tube and an inner seal tube made from a plastic resin, where the combination of the anchor tube, which may be selectively ribbed, with conventional grouting material affords optimum holding power in the bolt hole. Aside from the preceding, the roof bolt is generally standard in configuration and usage, including a bolt carrying a movable metal wedge which causes the outward spreading of the upper portion of the plastic anchor tube upon rotation of the bolt. The preceding may be used independently of or with a support system employing angled roof bolts which create, through tensioning, a cradling effect especially advantageous in the instance of a fragile mine roof condition.

9 Claims, 6 Drawing Figures

ROOF BOLT AND CRADLE ARRANGEMENT

As is known, the support of a mine roof is an important consideration both for operational and/or safety reasons. Previously, roof support has been typically accomplished through an assembly in a bolt hole including a base plate, a bolt extending through the plate and into an expansion shell to achieve spreading and engaging relationship of the latter with the inner wall of the bolt hole by reason of a movable wedge, and a rupturable container for a grout, polyester resin or cement disposed in the bolt hole above the bolt.

As the bolt is rotated, the wedge is drawn downwardly, anchoring a metal expansion shell and, hence, the roof bolt assembly into position, where, as the end of the bolt ruptures the aforesaid container, downward grouting material flow is caused, further positively anchoring the overall assembly for roof supporting.

A major objection to the preceding lies in the instance where the main roof has soft shale characteristics. The invention is presented to afford an arrangement achieving optimum holding power under such circumstances. More particularly, the invention provides an anchor tube and an inner seal tube both importantly made from a plastic resin, where such precludes or at least minimizes fracturing of the wall of the bolt hole in contrast to usage of metal component(s).

Restated otherwise, the plastic anchor tube affords a relatively flexible or non-rigid unit with an outer surface typically arranged for grouting flow and/or for securing purposes, and disposed between the bolt and the inner wall of the bolt hole. The plastic anchor tube employs a vee-cut upper end portion defining two prongs, contrasting to the two or three prong metal structures presently in use. The inner seal tube, also made from plastic resin, serves to keep grout from the threads of the roof bolt, affording a significant advantage in the instance where retightening is desired.

Moreover, the invention implements the roof supporting purposes by presenting a cradle system defined by angle brackets having a roof strap extending therebetween. Roof bolt assemblies extend through the angle brackets and provide not only strength through tensioning, but a fixed holding guide for accomplishing installation. In other words, the roof cradle herein, which may or may not be used with the defined roof bolt assembly, serves to create a tension which not only protects against a fragile immediate roof, but also a cradling effect to avoid falling of the main mine roof. Actually, the cradling afforded by the invention can be considered an effective combination of a roof mat system and a roof truss system.

As to each of the latter, a roof mat system is defined as a strap, including vertical bolts, which serves for the protection against fall of loose material therebetween. In a roof truss system, a rod connects angle bolts and a turnbuckle and applies tension designed to maintain the main roof in position, but is not applicable for the intermediate roof. The roof truss system involves many parts, is difficult to install and is prone to error on the part of the installer. Another drawback is that the preceding first requires immediate roof support and, thereafter, the installation of the truss system, thereby involving added expense in material and labor.

In any event, the importance of the invention lies in application to soft shale main roof conditions and/or like fragile roof situations. A better understanding of the present invention will become more apparent from the following description, taken in conjunction with the accompanying drawing, wherein FIG. 1 is a view in front elevation showing a roof bolt assembly in accordance with the teachings of the present invention;

Figures 1, 2, 3, 4, 5, 6:
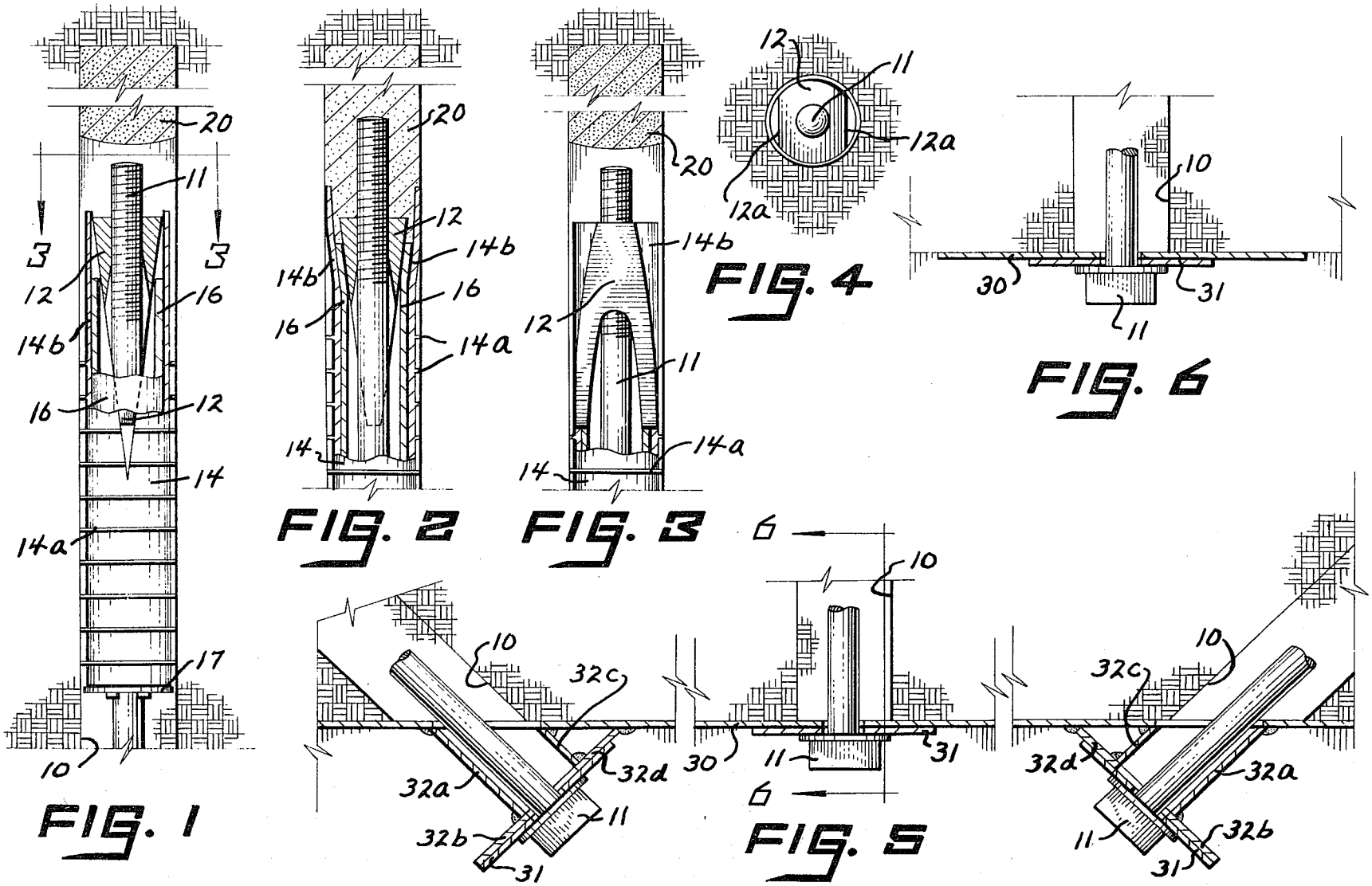
FIG. 2 is another view in front elevation of the roof bolt assembly of FIG. 1, but showing such in an installed or anchored condition.
FIG. 3 is yet another view in elevation, in this instance looking from right to left in FIG. 1, showing further details of the instant roof bolt assembly.
FIG. 4 is a top plan view, taken at line 4—4 on FIG. 1 and looking in the direction of the arrows, showing other details of the roof bolt assembly hereof.
FIG. 5 is a view in side elevation illustrating a roof cradle arrangement in accordance with the teachings of the present invention; and, FIG. 6 is another view in side elevation, in this instance taken at line 6—6 on FIG. 5 and looking in the direction of the arrows, showing further details of the instant roof cradle arrangement.

For the purposes of promoting an understanding of the principles of the invention, reference will now be made to the embodiments illustrated in the drawing and specific language will be used to describe the same. It will nevertheless be understood that no limitation of the scope of the invention is thereby intended, such alterations and further modifications of the illustrated devices and such further applications of the principles of the invention as illustrated therein being contemplated as would normally occur to one skilled in the art to which the invention relates.

Referring now to FIGS. 1, 2, 3 and 4, a roof bolt assembly in accordance with the teachings of the invention is shown in combination with a drilled bolt hole 10 disposed in the roof of a mine. Basically, a roof bolt 11, of customary configuration and not fully detailed in the drawing, extends through a base plate (also not illustrated) when installed. The roof bolt 11 threadedly engages a wedge 12, the latter being defined by oppositely disposed tapered flat side surfaces 12*a* (see FIG. 4).

Grouting material 20 is typically disposed in the bolt hole 10 above the roof bit 11, preferably in a rupturable container, and in the present invention may be construed as an integral part of the anchor. In an ordinary installation, the grouting material 20 might be, for example, a polyester with a catalyst; gypsum cement, in dry form, to which capsules of water are added; or even externally mixed cement. In any event, the grouting material 20 serves to seal the roof bolt 11, when anchored, against deterioration of the adjoining rock caused by air and moisture at the anchor zone. In addition, permanency implements the anchoring.

The importance of the invention lies in the usage of an anchor tube 14 and an inner seal tube 16 made from a plastic resin. The usage of a plastic anchor tube 14 affords a considerably advantageous seal in that such is more adaptable in conforming to the wall of the bolt hole 10, thereby being less likely to damage or crush the drilled material, as in the instance of prior forms of expansion shells. The assembly is completed through the provision of a tube stop 17, affixed to the shaft of the roof bolt 11 (see FIG. 1), to be discussed herebelow.

In any event, and with particular reference to FIGS. 1, 2 and 3, the plastic anchor tube 14 is designed to closely fit into the bolt hole 10, with ribs or ridges 14*a*, circumferentially disposed thereon at spaced-apart intervals, serving "dragging" purposes, i.e. against the wall of the bolt hole 10 during installation. Actually, it should be understood that the illustrations are somewhat exaggerated, for clarity, as to relative size and spacing and that, in reality, the drilled bolt hole 10 would not be as smooth or as well defined as shown.

The upper end portion of the plastic anchor tube 14 is defined by wings or prongs 14*b*, oppositely disposed and cooperable with the flattened side surfaces 12*a* of the wedge 12. In other words, through a physical relationship of this type, and as the roof bolt 11 is rotated into position, the aforesaid wings or prongs 14*b* are caused to flex outwardly (by wedge 12) into an anchoring engagement with the wall of the bolt hole 10. FIG. 1 illustrates the position of the wings or prongs 14*b* initially, i.e. before any flexing thereof is achieved, where FIG. 2 shows a flexed condition.

Grouting material is an integral part of the anchoring arrangement herein, being disposed between the wedge engaging surfaces of the plastic wings 14*b* and the metal wedge 12 and forced out and around the anchor by wedging action during tightening (see FIG. 2).

While the drawing illustrates the aforesaid circumferential ridges 14*a* on the outer surface of the plastic anchor tube 14, a combination of grooves in the upper portion and ridges on the lower portion thereof can also be employed. In other words, the concern is the effective passage of grouting material 20 to the annulus around the plastic anchor tube 14, filling any voids in the rock defining the wall of the bolt hole 10.

The plastic inner seal tube 16 fits closely inside the plastic anchor tube 14, serving to prevent downward movement of the grouting material 20 along the shaft of the roof bolt 11, i.e. limiting internal escaping. The plastic inner seal tube 16 also protects the roof bolt threads (representatively shown) from the grouting material 20, permitting ready retightening if later desired. The relationship of the plastic inner seal tube 16, the plastic anchor tube 14 and the shaft of the roof bolt 11 are, again, also representatively shown in the drawing for ready understanding.

Importantly, the use of a plastic material for both the anchor tube 14 and the inner seal 16 serves for effective wedging or anchoring action in the instance of a soft shale roof condition. The plastic material, which might be of the A.B.S. type, polyvinylchloride or other, affords a degree of flexibility not available with rigid material. Moreover, in addition to significantly important sealing characteristics, the plastic anchor tube 14 and inner seal tube 16 present a lesser cost to the user.

Additionally, and in considering installation, it should be understood that the tube stop 17 has a utilitarian function, i.e. such, in the form of a frangible washer, serves to support the plastic anchor tube 14 and force such into the bolt hole 10 until tightening is achieved. Subsequently, the tube stop 17 ruptures to permit the roof bolt 11 to thread into final anchoring position, placing tension against the roof and, hence, the desired positioning.

Referring now to FIGS. 5 and 6, the invention further encompasses a roof cradle arrangement basically defined by a roof strap 30, perhaps 6" in width, extending along and adjacent the surface of the mine roof. The roof strap 30 terminates in angle brackets 32, each defined by members 32*a*, 32*b*, 32*c* and 32*d*, secured together, as by welding, to define a roof bolt 11 receiving passageway. The angle brackets 32 at the ends of the roof strap 30 serve multi-functions, including (1) as a fixed holding guide for the roof bolts 11 and (2) for the strengthening of the end of the roof strap 30 to prevent tearing or other mutilation when the roof bolts 11 are tightened. As base plate 31 is representatively shown in the drawing.

The roof cradle arrangement is typically installed by temporarily holding the roof strap 30 against the roof; drilling and installing a center roof bolt 11, and, thereafter, drilling angle bolt holes at either end of the roof strap 30 at the angle brackets 32 and installing the roof bolts 11 therein. Actually, the effect of the roof cradle plays particular importance in the instance of a fragile intermediate roof by means of the tensioning afforded by the angled roof bolts 11. It might be noted that the usage of the aforedescribed center roof bolt 11 is optional. In any event, the arrangement of the invention is as effective as a known roof truss, but involves, perhaps, one-half the total cost of the latter.

From the preceding, it should be evident that the invention affords significant contributions to mine roof support, with the roof bolt assembly including a plastic anchoring tube 14 and a plastic inner seal tube 16, such assembly being used, if desired, in connection with the presented roof cradle arrangement. Each plays importance in the support of a mine roof having fragile physical properties. The roof bolt assembly of the invention may or may not be employed with the cradle arrangement, but a combination of such would serve optimum performance under soft shale roof conditions.

The roof bolt and cradle arrangement described above is susceptible to various changes within the spirit of the invention as, for example, in proportioning; the particular type of plastic employed; the manner of assembling the angle brackets defining the cradle system; the length of the shaft of the roof bolt; the particular outer configuration of the wedge; the surface characteristics of the plastic anchor tube; the method of applying grouting material; and, the like. Thus, the preceding description should be considered illustrative and not as limiting the scope of the following claims:

I claim:

1. A mine roof bolt assembly for a bolt hole comprising a roof bolt threadedly engaging a wedge member, a plastic inner seal tube surrounding the shaft of said roof bolt, a plastic anchor tube surrounding said plastic inner seal tube, said plastic anchor tube having an upper portion flexing into anchoring engagement with the wall of said bolt hole in response to axial movement of said wedge member along said shaft of said roof bolt, and a grouting material container selectively rupturable upon rotation of said roof bolt to define a grouting material flow path between said plastic anchor tube and the inner surface of said bolt hole.

2. The mine roof bolt assembly of claim 1 where said plastic anchor tube includes projections along the outer surface thereof in engagement with said inner surface of said bolt hole.

3. The mine roof bolt assembly of claim 1 where said plastic anchor tube includes grooved areas along the outer surface thereof.

4. The mine roof bolt assembly of claim 1 where said upper end portion of said plastic anchor tube defines prongs.

5. The mine roof bolt assembly of claim 1 where said grouting material is a preloaded part thereof.

6. In mine roof supporting, a cradle arrangement comprising a strap member disposed along said mine roof in an engaging and supportive relationship, and angle bracket members disposed on said strap member and extending outwardly, said angle bracket members each receiving a roof bolt assembly mounted in bolt holes in said mine roof in a tensioning relationship, said roof bolt assembly each being defined by a roof bolt threadedly engaging a wedge member, a plastic inner seal tube surrounding the shaft of said roof bolt, a plastic anchor tube surrounding said plastic inner seal tube, said plastic anchor tube having an upper portion flexing into anchoring engagement with the wall of said bolt hole in response to axial movement of said wedge member along said shaft of said roof bolt, and a grouting material container selectively rupturable upon rotation of said roof bolt to define a grouting material flow path between said plastic anchor tube and the inner surface of said bolt hole.

7. The cradle arrangement of claim 6 where another roof bolt assembly is disposed through the mid-area of said strap member.

8. The mine roof bolt assembly of claim 1 where said plastic inner seal tube and said plastic anchor tube are arranged in a relationship blocking grouting material flow therebetween.

9. The mine roof bolt assembly of claim 1 where said plastic inner seal tube is in a protective relationship over the threads on said roof bolt.

* * * * *